US006763202B2

(12) United States Patent
Maeda

(10) Patent No.: US 6,763,202 B2
(45) Date of Patent: Jul. 13, 2004

(54) IMAGE FORMING APPARATUS

(75) Inventor: Yuichiro Maeda, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/277,932

(22) Filed: Oct. 23, 2002

(65) Prior Publication Data

US 2003/0081232 A1 May 1, 2003

(30) Foreign Application Priority Data

Oct. 25, 2001 (JP) ..... 2001-327647
Sep. 2, 2002 (JP) ..... 2002-256699

(51) Int. Cl.[7] ..... G03G 15/00

(52) U.S. Cl. ..... 399/53; 399/227; 399/54

(58) Field of Search ..... 399/53, 54, 222, 399/223, 226, 227, 228, 107, 111, 112, 113, 119

(56) References Cited

U.S. PATENT DOCUMENTS 5,797,069 A * 8/1998 Kimura et al. ..... 399/113
6,122,470 A * 9/2000 Kimura ..... 399/227
6,295,429 B1 * 9/2001 Isobe et al. ..... 399/227

FOREIGN PATENT DOCUMENTS

JP 1-281467 11/1989

* cited by examiner

*Primary Examiner*—Hoang Ngo
(74) *Attorney, Agent, or Firm*—Fitzpatrick, Cella, Harper & Scinto

(57) ABSTRACT

An image forming apparatus having a latent image carrier, a first developing unit having a plurality of developing units and provided so as to face the latent image carrier at a predetermined developing position, and a second developing unit provided so as to face the latent image carrier at a developing position different from that for the first developing unit, wherein even if the first developing unit malfunctions, the second developing unit is used to form an image, if possible.

19 Claims, 12 Drawing Sheets

IMAGE FORMING APPARATUS

BACKGROUND OF THE INVENTION

1. Field of the Invention

The present invention relates to an image forming apparatus having a latent image carrier, a first of developing unit having a plurality of developing units and provided so as to face the latent image carrier at a predetermined developing position, and a second developing unit provided so as to face the latent image carrier at a developing position different from that for the first developing unit.

2. Related Background Art

In an image forming apparatus provided with a rotative color developing unit and a separate black developing unit, if the rotative color developing unit fails rotate correctly, this is treated as an error in the entire apparatus. Consequently, subsequent image formation is impossible. However, if a user forms black and white images more frequently than color images, it is desirable that even if only the rotative color developing unit rotates incorrectly, this is not treated as an error in the entire apparatus, so that the image forming apparatus allows at least only black and white images to be formed.

It is thus an object of the present invention to provide an image forming apparatus wherein even if the rotative color developing unit rotates incorrectly, only color image formation is disabled, while black and white images are allowed to be formed, depending on the positions of developing units of the rotative color developing unit, thereby minimizing the downtime of the apparatus to make the apparatus more convenient for the user.

SUMMARY OF THE INVENTION

The present invention provides an image forming apparatus including a latent image carrier, a first developing unit having a plurality of developing units and provided so as to face the latent image carrier at a predetermined developing position, and a second developing unit provided so as to face the latent image carrier at a developing position different from that for the first developing unit, and having a first mode in which images are formed using the first developing unit and a second mode in which images are formed without using the first developing unit, wherein such control is provided that the first mode is avoided depending on an operational status of the first developing unit. This minimizes the downtime of the apparatus to make the apparatus more convenient for the user.

Furthermore, such control is provided that if it is detected that the first developing unit is rotating incorrectly, the first mode is avoided and images are formed in the second mode, depending on the rotative position of the first developing unit. This minimizes the downtime of the apparatus to make the apparatus more convenient for the user.

If it is detected that the first developing unit is rotating incorrectly, the second developing unit is used to form images if this is possible, on the basis of the rotative position of the first developing unit. This minimizes the downtime of the apparatus to make the apparatus more convenient for the user.

According to the present invention, in an image forming apparatus such as a copier which is provided with a rotative color developing unit and a separate black developing unit, if the rotative color developing unit does not rotate correctly but black and white images can be formed, then only color image formation is disabled, while black and white images are allowed to be formed. This minimizes the downtime of the apparatus to make the apparatus more convenient for the user.

Furthermore, according to the present invention, if it is detected that the first developing unit is incorrect during the use of the first developing unit, when it is possible to form the images by using the second developing unit, such an effect as to improve the convenient of the user can be realized by using the second developing unit in accordance with the user's intention to continue the image formation.

An embodiment of the present invention provides an image forming apparatus (an image forming apparatus 100, shown in FIG. 1) including a latent image carrier (a photosensitive drum 111, shown in FIG. 1), a first developing unit (rotative color developing means 116, shown in FIG. 1) having a plurality of developing units (developing units 122, 123, and 124 corresponding to magenta, yellow, and cyan, respectively, as shown in FIG. 1), and a second developing unit (a black developing unit 115, shown in FIG. 1) provided so as to face the latent image carrier at a developing position different from that for the first developing unit. The apparatus further includes an operation determining unit (a program stored in a ROM in a main body control unit 200) that determines an operational status of the first developing unit, a first mode (a color image formation mode) in which the first developing unit is used to form an image, and a second mode (a B/W image formation mode) in which an image is formed without using the first developing unit, such control being provided that the first mode is avoided (the main body control unit 200 disables the color image formation mode, while enabling the B/W image formation mode) on the basis of a result of the determination by the operation determining unit. Other objects and features of the present invention will be apparent from the following specification and drawings.

DESCRIPTION OF THE PREFERRED EMBODIMENTS

Figure 1:
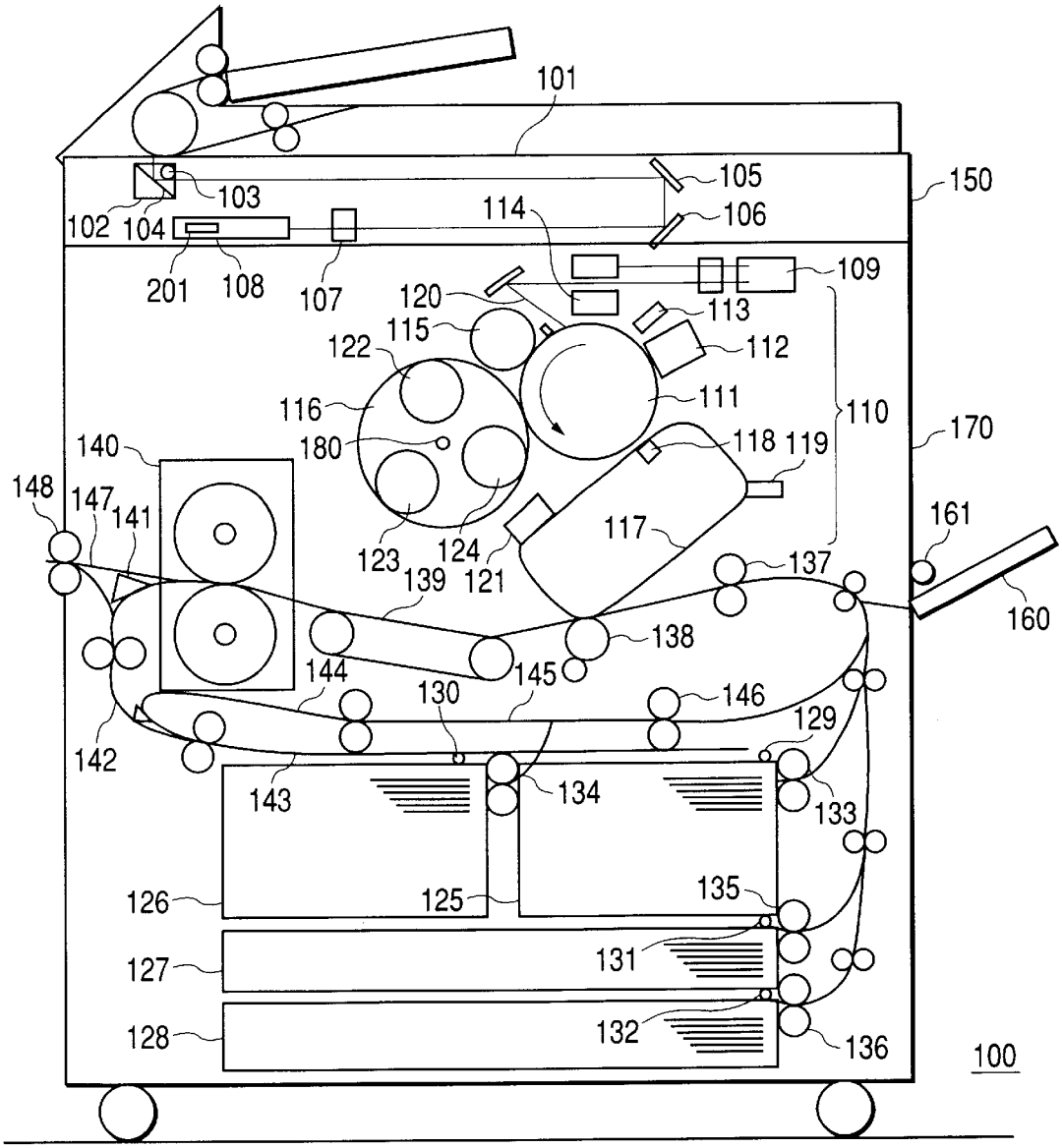
FIG. 1 is a sectional view showing a configuration of an image forming apparatus 100 according to an embodiment of the present invention.

An image forming apparatus 100 will be described below with reference to the accompanying drawings. In the drawings, those which carry the same reference numerals denote the same members. Duplicate description is omitted. FIG. 1 is a schematic sectional view of an image forming apparatus 100, showing a first embodiment of the present invention. The image forming apparatus 100 has a digital color image reader unit 150 (hereinafter referred to as a "reader unit 150") at the top thereof and a digital color image printer unit 170 (hereinafter referred to as a "printer unit 170") at the bottom thereof.

The reader unit 150 comprises a copy board glass 101 used as a sheet supporting table, a scanner 102, a sheet illuminating lamp 103, scanning mirrors 104 to 106, a lens 107, and a full-color image sensor unit 108 (hereinafter referred to as an "image sensor unit 108"). The scanner 102 is driven by a motor (not shown) to scan sheets (originals) by reciprocating in predetermined directions. The sheet illuminating lamp 103 is a lamp that irradiates the sheets with light. When the scanner 102 scans the sheet loaded on the copy board glass 101, an optical image obtained when light from the sheet illuminating lamp 103 is reflected by the sheet is sequentially passed through the scanning mirrors 104 to 106 and the lens 107 to form an image in a CCD sensor 201 in the image sensor unit 108 integrated with an RGB three-color separation filter. Consequently, color-separated image analog signal is obtained. The color-separated image analog signal is digitized through an amplifying circuit (not shown) in a CCD sensor 201, described later. The printer unit 170 has an image forming unit 110. The image forming unit 110 is composed of a laser unit 109, a photosensitive drum 111, cleaning means 112, a pre-exposure lamp 113, a primary charger 114, a black developing unit 115, a rotative color developing unit 116, an intermediate transfer belt 117, and a primary transfer charger 118.

The laser unit 109 is composed of a laser light generating unit, polygon scanner, and others. The laser light generating unit generates laser light 120 modulated on the basis of an image signal converted into an electric signal by the image sensor unit 108 and then subjected to a predetermined image process, and irradiates the photosensitive drum 111 as a latent image carrier, with this light. The photosensitive drum 111 is driven in the direction of the arrow in the drawing by a motor (not shown), has its static electricity eliminated by the pre-exposure lamp 113, and is then uniformly charged to a predetermined potential by the primary charger 114. Then, the photosensitive drum 111 is irradiated with the laser light 120 from the laser unit 109 to form a static latent image. The static latent image formed on the photosensitive drum 111 is developed by operating a predetermined developing unit. Thus, a toner image is formed on the photosensitive drum 111.

The rotative color developing unit 116 has developing units 122, 123, and 124 arranged around an axis of rotation 180 and corresponding to magenta, yellow, and cyan. When a toner image is formed on the photosensitive drum 111 and it is colored, it is developed by activating a stepping motor (not shown) to rotate a predetermined one of the developing units 122 to 124 of the rotative color developing unit 116 around the axis of rotation 180, depending on each separated color to be developed, to move the developing unit to a developing position at which the developing unit is in contact with (or lies in the vicinity of) the photosensitive drum 111. When black is developed, the black developing unit 115, which lies in the vicinity of (or in contact with) the photosensitive drum 111, is used. That is, if a white and black image is formed, only the black developing unit 115 is used. In this case, the motor is rotated so as to hold the developing units 122, 123, and 124 of the rotative developing unit, corresponding to magenta, yellow, and cyan, at predetermined positions referred to as "home positions", described later. Magenta, yellow, and cyan toners each use two-component toner. Black toner uses one component toner. Further, the developing units have respective developing sleeves.

A toner image developed on the photosensitive drum 111 is transferred to the intermediate transfer belt 117 by a high voltage applied by the primary transfer charger 118. To form a color image, four color toner images are transferred to the intermediate transfer belt 117 so that the images are superimposed on one another. To form a black and white image, only a black toner image is transferred. In this embodiment, if recording materials have a length equal to or smaller than half of the entire circumference of the intermediate transfer belt, images corresponding to two recording materials can be simultaneously formed on the intermediate transfer belt. After a primary transfer has been completed, the photosensitive drum 111 has residual toner removed from its surface by the cleaning means 112, and is then used for an image forming process again.

The printer unit 170 has a secondary transfer charger 138, a sheet conveying belt 139, a fixing unit 140, a sheet discharging flapper 141, a right cassette deck 125, a left cassette deck 126, an upper cassette deck 127, and a lower cassette deck 128. The cassette decks 125 to 128 store recording sheets to which a toner image formed on the intermediate transfer belt 117 in the image forming unit 110 is transferred.

The recording sheets stored in the right cassette deck 125 are fed by a pickup roller 129 and a sheet feeding roller 133 and conveyed by a resistration roller 137 to a secondary transfer position at which the toner image on the intermediate transfer belt 117 is transferred to the recording sheet. Similarly, the recording sheets in the left cassette deck 126 are fed by a pickup roller 130 and a sheet feeding roller 134. The recording sheets in the upper cassette deck 127 are fed by a pickup roller 131 and a sheet feeding roller 135. The recording sheets in the lower cassette deck 128 are fed by a pickup roller 132 and a sheet feeding roller 136. All recording sheets are then conveyed to the secondary transfer position by the registration roller 137.

In the image forming unit 110, after the toner image has been transferred to the intermediate transfer belt 117, the recording material conveyed from the cassette deck to the registration roller 137 is conveyed to a position on the secondary transfer roller 138 which corresponds to the secondary transfer position. Then, a secondary transfer to the recording material is carried out. After the secondary transfer has been completed, the intermediate transfer belt 117 has residual toner removed from its surface by the cleaning means 121, and is then used for an image forming process again. Further, in this embodiment, a gap between the intermediate transfer belt 117 and the secondary transfer roller 138 can be arbitrarily set by operating an eccentric cam (not shown) on the basis of a predetermined timing. In forming a color image, the gap is formed if toner images of different colors are superimposed on each other on the intermediate transfer belt 117 and the gap is not formed if a toner image is transferred to the recording sheet. Further, a gap is formed in a standby or power-off state.

The recording sheet for which the secondary transfer has been completed passes through the secondary transfer roller, and is then conveyed by the sheet conveying belt 139. Then, the recording sheet is heated by the thermal roller fixing unit 140 to fix the toner transferred to the recording sheet. The sheet is then discharged out from the image forming apparatus main body 100 by a discharging roller 148.

The sheet discharging flapper 141 is activated to select discharge destination of the recording sheet to which the toner has been fixed, to a conveying path 142 or a discharging path 148. If an image is formed on only one side of the recording paper, the sheet discharging flapper is switched to the discharging path 148. If images are formed on both sides of the recording paper, the sheet discharging flapper is switched to the conveying path 142, so that the conveyed recording sheet is conveyed to a lower conveying path 144 via an inverting path 143 and guided to a sheet refeeding path 145. At this time, the recording sheet is turned upside down upon passing through the inverting path 143 and the lower conveying path. Further, if the recording sheet is turned upside down before being discharged from the image forming apparatus main body 100, the sheet feeding flapper is switched to the conveying path 142 to draw the recording sheet into the inverting path 143. Then, the inverting roller 142 is reversely rotated to convey the recording sheet to the discharging roller 148.

Figure 2:
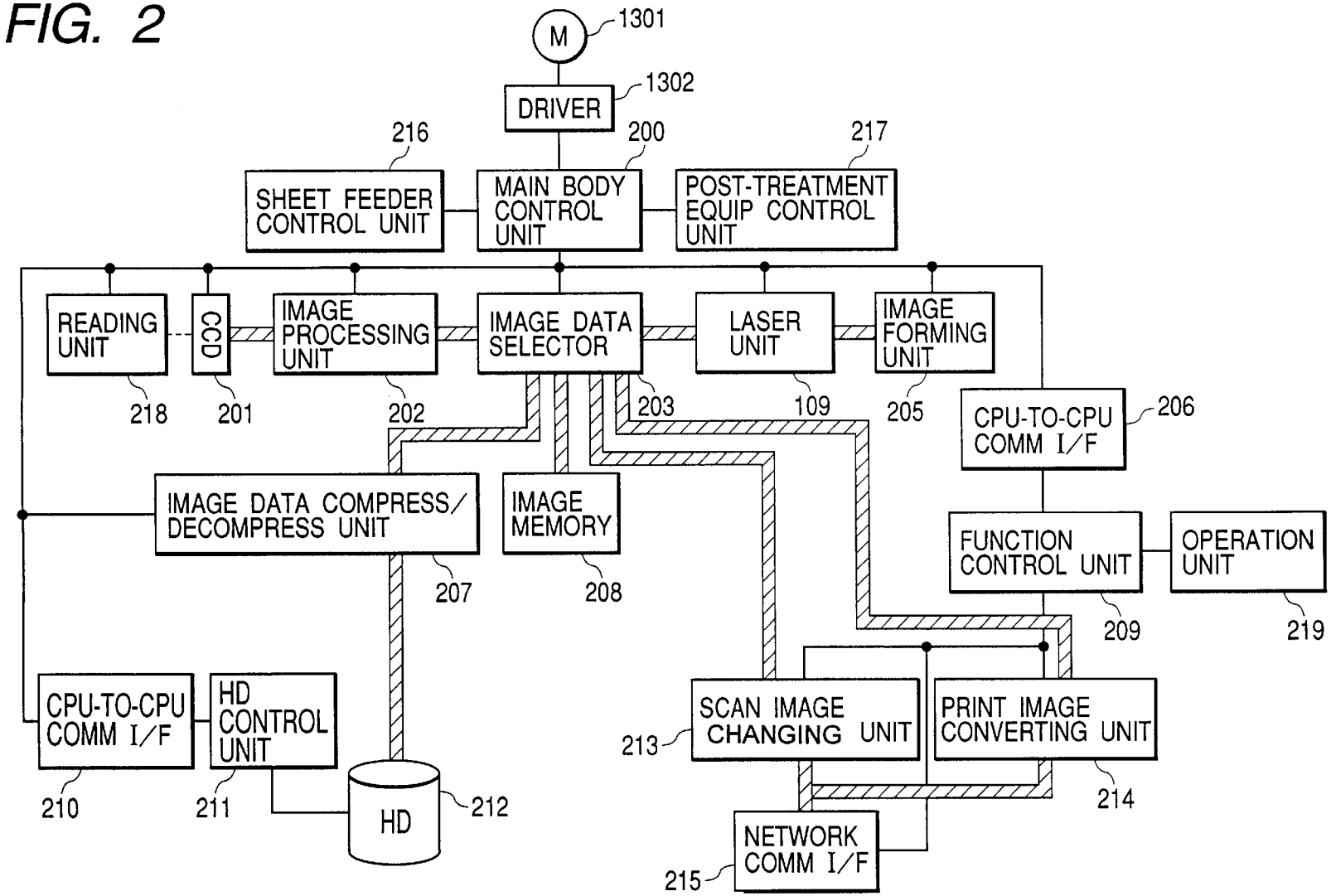
FIG. 2 is a block diagram showing a control circuit for the image forming apparatus 100.

FIG. 2 is a block diagram showing a configuration of a control circuit for the image forming apparatus 100. The control circuit for the image forming apparatus 100 has a main body control unit 200, a CCD 201, an image processing unit 202, an image data selector 203, a laser unit 109, an image forming unit 205, a CPU-to-CPU communication I/F unit 106, an image data compress/decompress unit 207, an image memory 208, a function control unit 209, a CPU-to-CPU communication I/F unit 210, an HD (Hard Disk) control unit 211, an HD (Hard Disk) 212, a scan image changing unit 213, a print image converting unit 214, a network communication I/F unit 215, a sheet feeder control unit 216, a post-treatment equipment control unit 217, a reading unit 218, and an operation unit 219.

In this case, the main body control unit 200 controls driving of the reader unit 150 provided in the image forming apparatus 100, the image forming unit 110, and others. Further, the main body control unit 200 is comprises of a CPU, a RAM that provides a work area for the CPU, and a ROM that stores a control program for the CPU. The ROM stores a control program that executes operation modes such as an automatic color selection (ACS) mode in which color image formation and B/W image formation are switched, a color image formation mode (also referred to as a "color mode"), and a B/W image formation mode, described later. The ROM also stores a control program that controls the entire image forming apparatus 100. For example, it stores a control program that uses the image processing unit 202 to convert image data read by the CCD 201 into predetermined image data, and a control program that selects one of the laser unit 109, the image data compress/decompress unit 207, the image memory 208, and the function control unit 209 to send image data received by the image data selector 203 to thus selected one. It also stores a control program that uses the sheet feeder control unit 216 to feed a sheet, a control program that executes a predetermined mode set in the post-treatment equipment control unit 217 for post-treatment equipment, not shown in FIG. 1, a control program that executes a predetermined process on image data, and a control program that provides such control that, for example, the image forming apparatus 100 executes an index sheet insertion mode.

The image processing unit 202 executes a predetermined image process on image data output by the CCD 201. The predetermined image process corresponds to an image processing mode set via the operation unit 219. The image data selector 203 is connected to each unit via an image data bus to receive control information from the main body control unit 200 and then determine a direction in which image data flows, on the basis of the received control information. The laser unit 109 is as previously described in FIG. 1.

The CPU-to-CPU communication I/F unit 206 is an interface that receives transmits control information between the main body control unit 200 and the function control unit 209. The function control unit 209 communicates with the main body control unit 200, and transmits image data control information received from the main body control unit 200, to the scan image changing unit 213 and the print image converting unit 214. The image data control information may include control information for sending image data transmitted by the image data selector 203 to the scan image changing unit 213 and control information for sending image data transmitted by the print image converting unit 214 to the image data selector 203. Further, the print image converting unit 214 receives print image data from the network communication I/F unit 215, executes a predetermined converting process on the received image data, and transmits the converted image data to the image data selector 203. Further, the function control unit 209 transmits control information input via the operation unit 219 to control the entire image forming apparatus 100, to the main body control unit 200 via the CPU-to-CPU communication I/F unit 206.

The scan image changing unit 213 converts image data transmitted by the image data selector 203 into image data represented in a PDL (Page Description Language), and transfers the converted image data to a host computer (not shown) connected thereto via the network communication I/F unit 215. The above described host computer can process the image represented in the PDL. Further, the scan image changing unit 213 converts PDL image data received from the host computer into image data of a format that can be printed and output by the image forming unit 110. Further, the converting process executed by the scan image changing unit 213 is based on control provided by the main body control unit 200. The network communication I/F unit 215 connects the image forming unit 100 to a network. On the basis of a predetermined communication protocol, image data and control information are transmitted to and received from an equipment (e.g. a computer) connected to the network.

The sheet feeder control unit 216 controls a sheet feeder 180 on the basis of control information transmitted by the main body control unit 200. The post-treatment control unit 217 controls post-treatment equipment 190 on the basis of control information transmitted by the main body control unit 200. The reading control unit 218 controls an optical unit drive device on the basis of control information transmitted by the main body control unit 200. The optical unit drive device drives the reader unit 150. Further, the optical reader unit 150 comprises the sheet illuminating lamp 103, the scanning mirrors 104 to 106, the lens 107., and others. These means are used to irradiate the document sheet with light. Further, the optical unit is driven to illuminate an image recorded on the sheet to form an image in the CCD 201.

When inputting information to the image forming apparatus 100, the user uses the operation unit 219. Further, the operational status of the image forming apparatus 100 is indicated to the user via the operation unit 219. Key information input via keys provided on the operation unit 219 is communicated to the function control unit 209. The function control unit 209 analyzes a command in the key information and transmits the analyzed command to the main body control unit 200 via the CPU-to-CPU communication I/F unit 206. The control information input by the user is thus communicated to the main body control unit 200.

Figure 3:
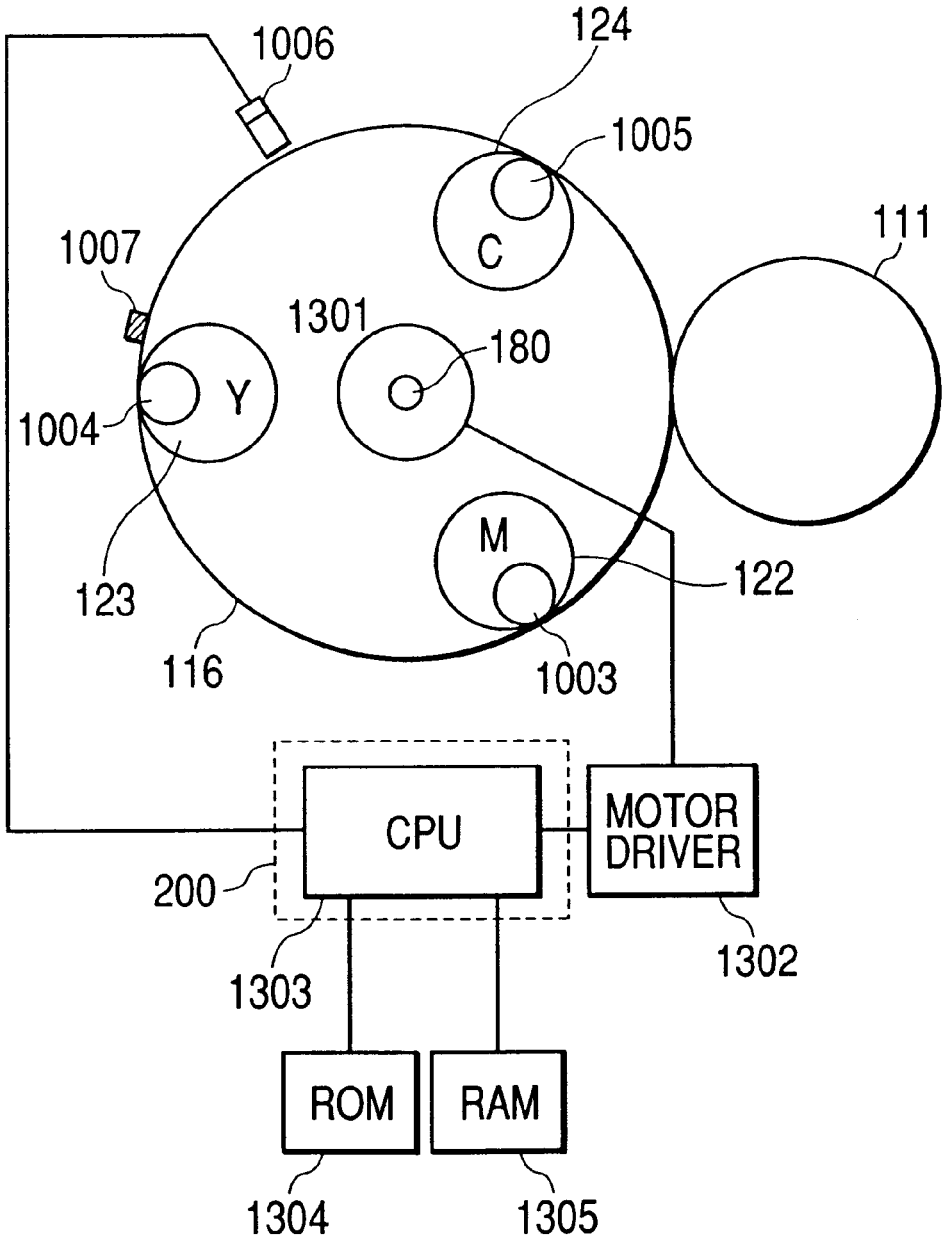
FIG. 3 is a block diagram showing a control circuit for a rotative color developing unit 116.

FIG. 3 is a block diagram showing the configuration of a control circuit for the rotative color developing unit 116. An image is developed by activating a stepping motor 1301 to rotate a predetermined one of the developing units 122 to 124 of the rotative color developing unit 116 around the axis of rotation 180, depending on each separated color to be developed, to move the developing unit to a developing position at which the developing unit is in contact with (or lies in the vicinity of) the photosensitive drum 111. The control unit for the rotative color developing unit 116 has the stepping motor 1301, a motor drive 1302, a CPU 1303 for the main body control unit 200, a ROM 1304, a RAM 1305, and an optical sensor 1006. The CPU 1303 for the main body control unit 200 transmits pulses to the motor driver 1302 which controls the stepping motor 1301 when the rotative color developing unit 116 is rotated. Further, a program stored in the ROM for the main body control unit 200 determines the status of the rotative operation on the basis of the relationship between production of pulses and detection of a home position flag 1007 by the optical sensor 1006.

Figure 4:
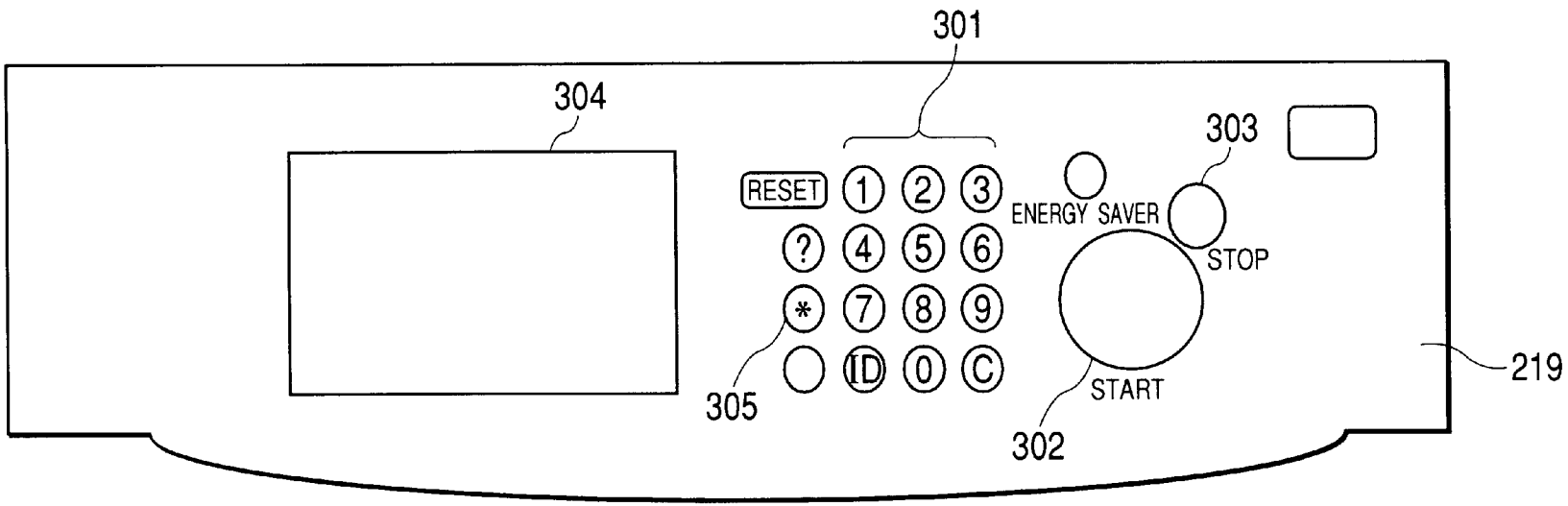
FIG. 4 is a view showing a configuration of an operation unit 219.

FIG. 4 shows a configuration of the operation unit 219. The operation unit 219 has ten-key 301, a start key 302, a stop key 303, an LCD 304, and a user mode key 305. The ten-key 301 is used by the user to input the number of copies and the amount of movement of an image during copying. The start key 302 is depressed by the user to start a copy job. The stop key 303 is depressed by the user to stop the started job. The LCD 304 is a display unit that displays the operational status of the image forming apparatus 100. Further, the LCD 304 is provided with a panel switch via which the user can set a copy job mode.

The user mode key 305 is depressed by the user to display a user mode screen on the LCD 304. In the user mode screen, the user can set a specification for each of the functions of the image forming apparatus 100, i.e. standard operations of a copier. For example, the user can set a mode selected as a standard (default) if the user has not specified (1) the automatic color selection mode (ACS) mode in which it is checked whether an image to be formed is colored or black and white, and color image formation or B/W image formation is selected accordingly, (2) the color image formation mode (also referred to as the "color mode"), or (3) the B/W image formation mode (also referred to as the "black and white mode"), the modes being described later. Further, user can set whether or not the vertical and horizontal paper sizes are input if paper of an unfixed form size is used in the B/W image formation mode, and can set whether the vertical and horizontal paper sizes are initially input or when a colored sheet is detected if paper of an unfixed form size is used in the automatic color selection mode.

Figure 5:
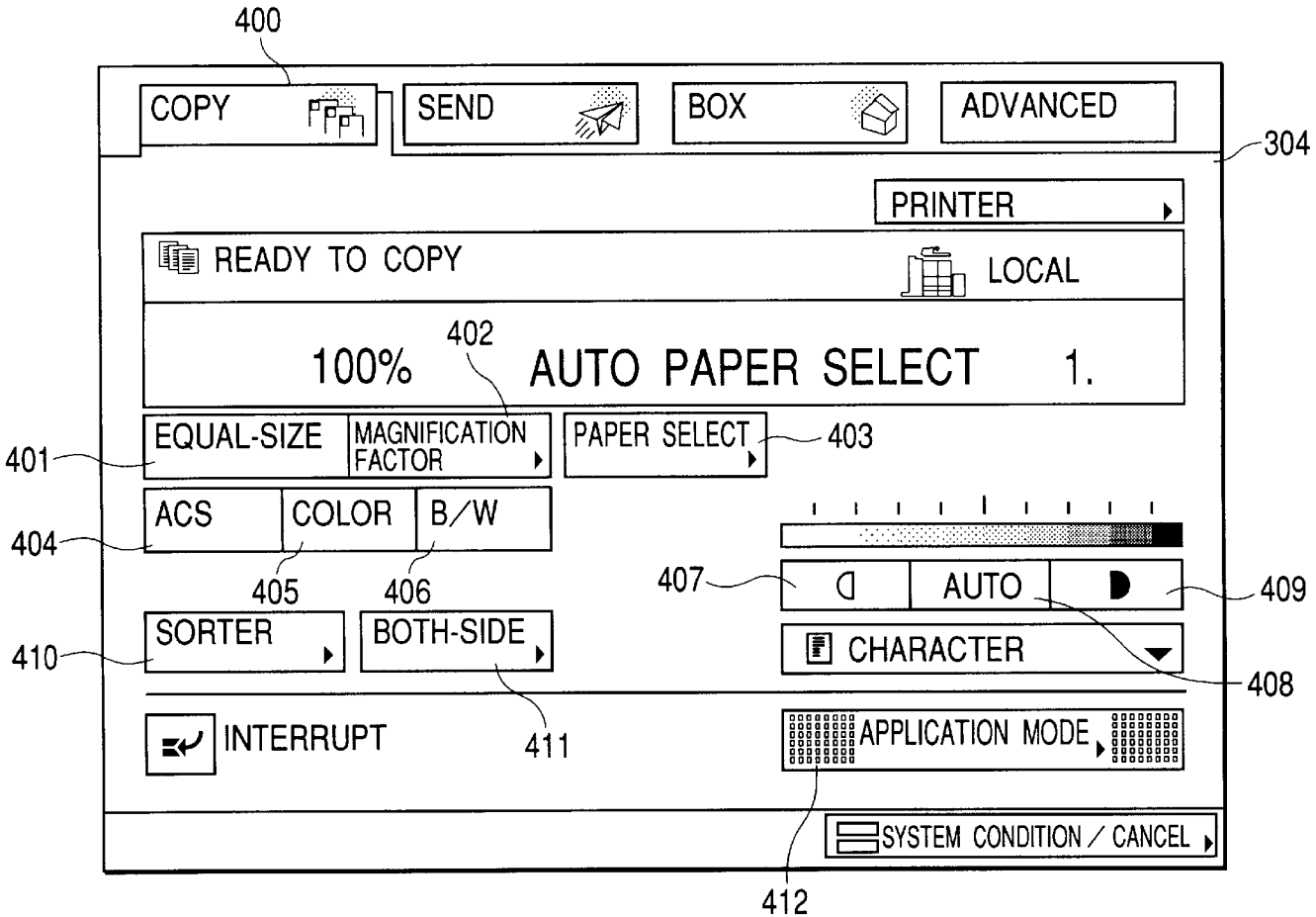
FIG. 5 is a view showing an LCD standard screen 400 on the operation unit.

FIG. 5 shows a display screen in a standard state of the LCD 304. In a screen 400, reference numerals 401 and 402 denote buttons used to set a scale (magnification factor) in forming an image. Reference numeral 403 is a paper select button used to specify the size of paper such as various fixed form sizes and an unfixed form size. Reference numerals 404, 405, and 406 denote buttons used to form images in the automatic color selection (ACS) mode, the color mode, and the black and white mode, respectively. One of these three buttons is exclusively selected, and all of them cannot be simultaneously selected. Reference numerals 407, 408, and 409 denote buttons used to adjust the printing density of an image. Reference numeral 410 denotes a button used to specify a process such as stapling executed on a bundle of recording sheets by a sheet discharge processing device (not shown). Reference numeral 411 denotes a button used to specify, when images on an original sheet are recorded on a recording sheet, whether the image on one side of the original sheet is recorded on one side of the recording sheet, the image on one side of the original sheet is recorded on both sides of the recording sheet, the images on the respective sides of the original sheet are recorded on one side of the recording sheet, or the images on the respective sides of the original sheet are recorded on the respective sides of the recording sheet. Reference numeral 412 denotes a button used to specify one of various application modes.

Figure 6:
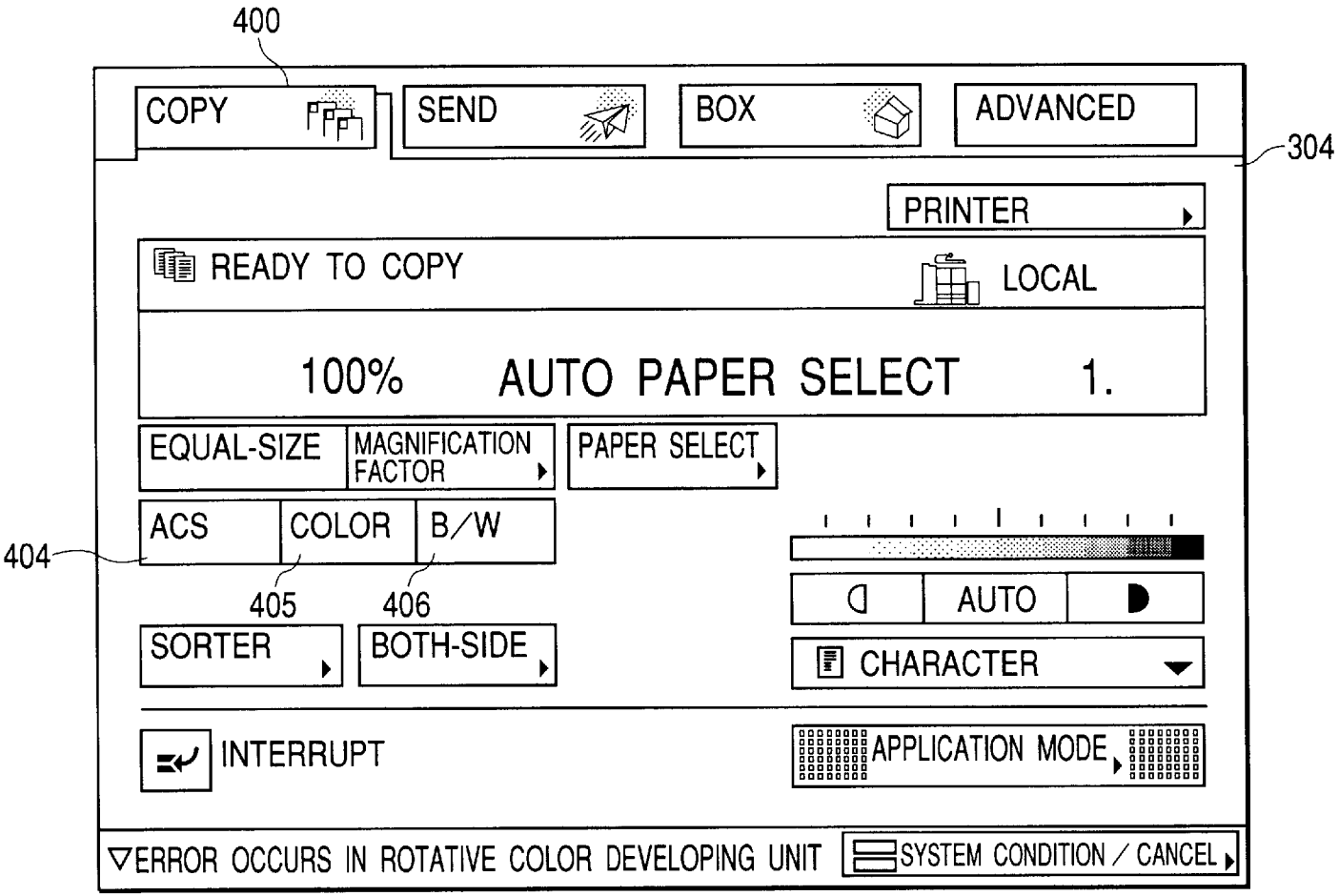
FIG. 6 is a view showing an LCD screen 500 on the operation unit displayed when a rotative developing unit error determining unit determines that the rotative color developing unit is rotating incorrectly.

FIG. 6 show an example of a display screen on the LCD 304 displayed when the main body control unit 200, described later, determines that an error is occurring in the rotative color developing unit 116. In this state, if the main body control unit 200 determines that the rotative color developing unit 116 is rotating incorrectly, and none of the developing sleeves 1003, 1004, and 1005 of the developing units constituting the rotative color developing unit 116 are arranged opposite the photosensitive drum 111 or in the vicinity thereof (FIG. 9; the details will be described later), then the automatic color selection (ACS) mode and the color mode are disabled, whereas image formation is enabled only in the black and white mode. Alternatively, the display luminance (or density) of the buttons 501 and 502, used to select the automatic color selection (ACS) mode and the color mode, respectively, may be reduced to indicate that these modes cannot be selected (and such control is provided that inputs to the buttons 501 and 502 are actually neglected).

If any one of the developing sleeves 1003, 1004, and 1005 of the developing units constituting the rotative color developing unit 116 is arranged opposite the photosensitive drum 111 or in the vicinity thereof, i.e. it is present within a first area including a position opposite to the photosensitive drum (FIG. 9; the details will be described later), i.e. any one of the developing units constituting the color developing unit is located opposite the photosensitive or in the vicinity thereof, so that the color developing unit may affect image formation in the black and white mode, then image formation is disabled not only in the color selection (ACS) mode and the color mode but also in the black and white mode. In this case, an error in the rotative color developing unit 116 is indicated on the LCD 304 ("Error Occurs In Rotative Color Developing Unit"). Furthermore, the start key 302 on the operation unit 219 is lighted red and is controlled by the operation unit 219 and the function control unit 209 so that it cannot be depressed.

An error in the rotative color developing unit 116 is determined when the rotative color developing unit 116 is driven. The rotative color developing unit 116 is driven when it is moved to its home position and when a developed color is switched during color image formation in the color mode or the automatic color selection (ACS) mode or the like. Description will be given below of the operation of moving the rotative color developing unit 116 to its home position and detection of an error in this operation. Then, description will be given of the operation of switching the developed color and detection of an error in this operation.

Figure 7:
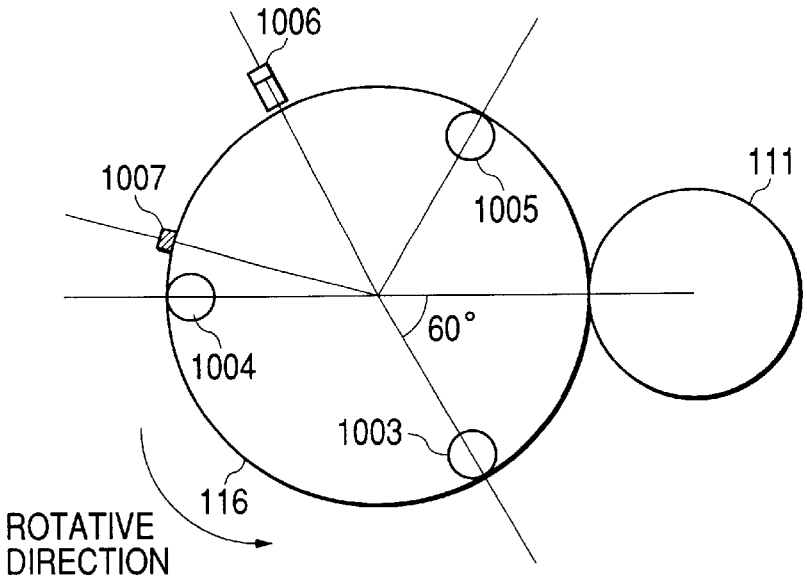
FIG. 7 is a diagram showing a relationship between a home position 1007 and an optical sensor 1006.

FIG. 7 shows a positional relationship among the home position 1007, the developing sleeves 1003, 1004, and 1005 and the photosensitive drum 111. The main body control unit 200 causes the rotative color developing unit 116 to remain in a predetermined rotative position, that is, the home position except when developing is being carried out in the color mode or the automatic color selection (ACS) mode. The home position is located at an angle of 60° to the position at which the developing sleeve 1003 for magenta (the first developing color) is arranged opposite the photosensitive drum 111. The rotative color developing unit 116 has the home position flag 1007 attached thereto. To move the rotative color developing unit 116 to its home position, the main body control unit 200 activates the stepping motor to rotate the rotative color developing unit 116. The main body control unit 200 then moves the rotative color developing unit 116 to its home position by rotating the motor by an amount corresponding to a predetermined number of pulses starting at the point of time when the optical sensor 1006 detects the home position flag 1007.

This home position detecting operation, required to move the rotative color developing unit 116 to its home position, is performed when the image forming apparatus 100 is powered on, when a low power consumption mode is switched to a normal mode, after a front door cover (not shown) of the image forming apparatus 100 is closed owing to a jam process or the like, and each time a developing process with the three colors, magenta, yellow, and cyan has been completed in order to form an image in the color mode or the automatic color selection (ACS) mode.

During the home position detecting operation, if the optical sensor 1006 fails to detect the home position 1007 in spite of pulses transmitted to the stepping motor, which rotates the rotative color developing unit 116, the pulses corresponding to one rotation of the rotative color developing unit 116, then the program stored in the ROM of the main body control unit 200 determines that the rotative color developing unit 116 is rotating incorrectly. The result of detection by the optical sensor 1006 is communicated to the CPU of the main body control unit 200 as shown in FIG. 3. Further, the pulses transmitted to the stepping motor 1301, which rotates the rotative color developing unit 116, are actually transmitted by the CPU of the main body control unit 200 to the motor driver 1302 which controls the stepping motor 1301.

Figure 8:
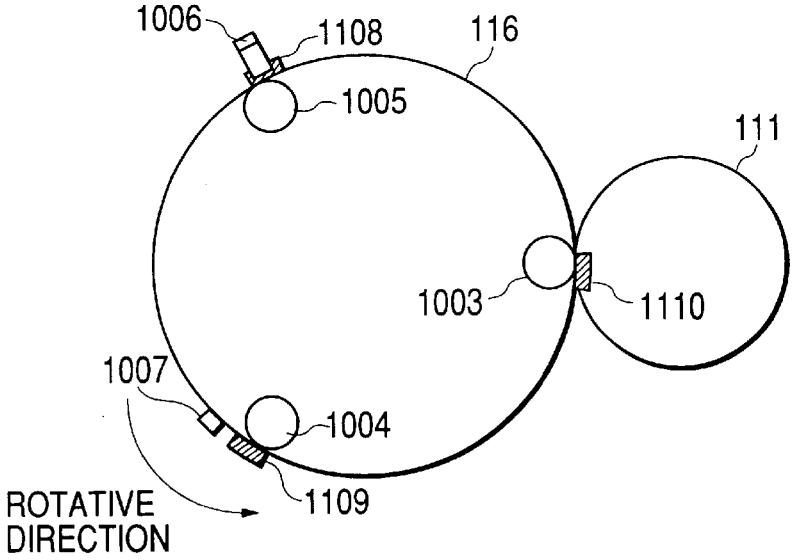
FIG. 8 is a diagram showing a relationship between developing position detecting flags 1108, 1109, and 1110 and the optical sensor 1006.

FIG. 8 shows a relationship among the developing position detecting flags 1108, 1109, and 1110, the developing sleeves 1003, 1004, and 1005, the optical sensor 1006, and the photosensitive drum 111. The rotative color developing unit 116 has the developing position detecting flags 1108, 1109, and 1110 attached thereto, in addition to the home position flag 1007. The developing position detecting flags 1108, 1109, and 1110 are attached at such positions that when the developing sleeves 1003, 1004, and 1005 are located opposite the photosensitive drum 111 or in the vicinity thereof, the detecting flags 1108, 1109, and 1110, respectively, are detected by the optical sensor 1006.

Figure 9:
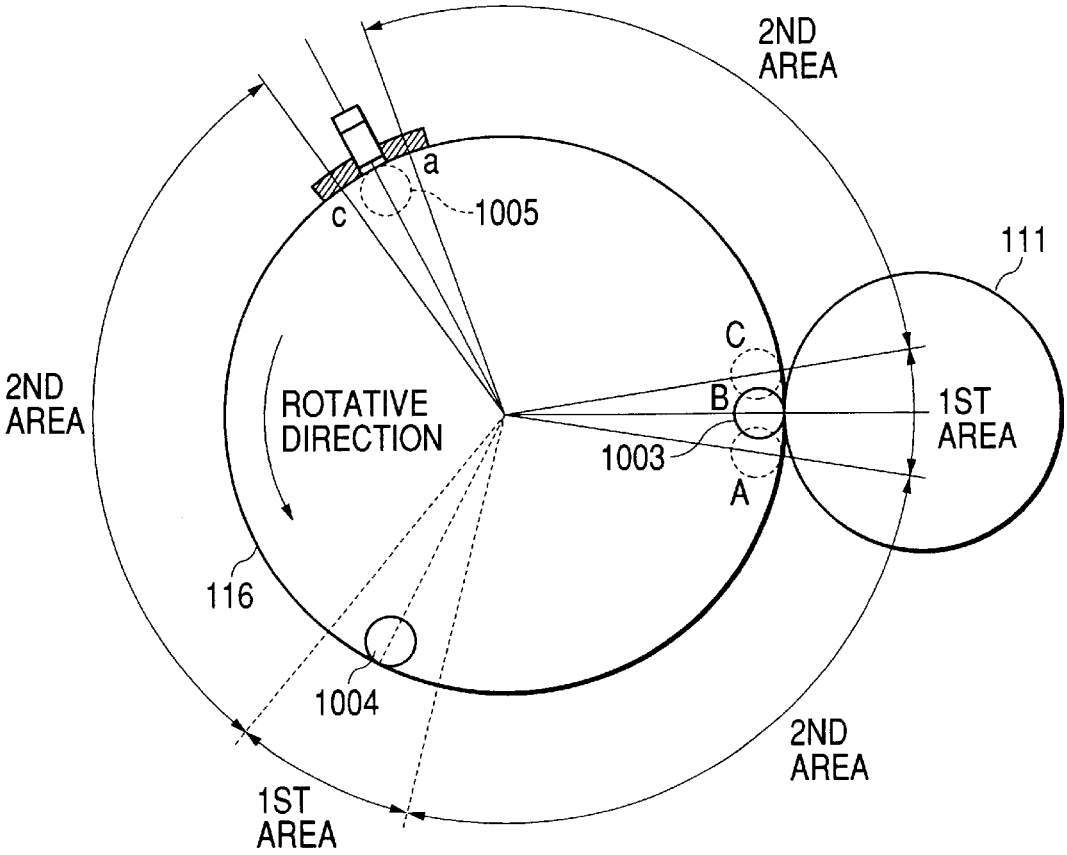
FIG. 9 is a diagram showing a first area including a position opposite to a photosensitive drum 111 of the rotative color developing unit and a second area.

FIG. 9 shows a position at which the developing sleeve 1003 is located opposite the photosensitive drum 111 or in the vicinity thereof. The following description also applies to the developing sleeves 1004 and 1005. The term "face or opposite" as used herein refers to a position B in FIG. 9 where the developing sleeve carries out development. Further, the term "vicinity" as used herein refers to the state in which the developing sleeve is located between positions A and C (except for the position B, where the developing sleeve faces the photosensitive drum). In this embodiment, at the positions A and C, the gap between the developing sleeve and the photosensitive drum 111 is 3 or mm greater. The size of the gap is determined on the basis of a position at which the rotative color developing unit 116 does not affect image formation in the black and white mode. The positions A and C may depend on a developing method used by the apparatus, e.g. whether the method is based on a jumping phenomenon or a contact phenomenon, and on the configuration of the apparatus, e.g. whether the toner is one-component toner or two-component toner or is non-magnetic or magnetic. Further, the distance between the positions A and C is preferably set at a larger value in order to prevent the black and white mode from being affected. Furthermore, in the above description, the positions A and C are defined on the basis of the gap between the developing sleeve and the photosensitive drum 111. However, since the developing sleeve is included in each of the developing units for the respective colors constituting the rotative color developing unit, the positions A and C may be defined on the basis of the positional relationship between the developing unit and the photosensitive drum 111.

The lengths of the developing position detecting flags are adjusted so that when the developing sleeve reaches the position A, the developing position detecting flags 1108, 1109, and 1110 are present at a position a just before when the optical sensor 1006 can detect these flags, so that when the developing sleeve reaches the position C, the developing position detecting flags are present at a position c just after when the optical sensor 1006 completes to detect the flags, and so that between the positions A and C, the optical sensor 1006 keeps detecting the developing position detecting flags.

In this embodiment, the same optical sensor 1006 can detect the home position flag 1007 and the developing position detecting flags 1108, 1109, and 1110 because these flags are arranged on a circumference of the rotative color developing unit 116 at the same end thereof. Further, the home position flag 1007 has a length different from that of the developing position detecting flags 1108, 1109, and 1110, so that the flags can be distinguished from the latter on the basis of the difference in the time of detection by the optical sensor 1006.

Of course, the flags can be distinguished from each other by increasing the number of optical sensors and changing the position of the circumference around which the flags are installed. Further, in this embodiment, while the optical sensor 1006 is detecting the developing position detecting flags, it is not detected where the rotative color developing unit 116 is between the positions A and C. However, it is known that the rotative color developing unit 116 is located between the positions A and C. The precise position can be detected by measuring the time elapsing after the optical sensor 1006 has detected the flags, by counting the number of pulses transmitted to the stepping motor, or altering the shapes or number of developing position detecting flags. The present invention does not limit the arrangement or number of sensors or the arrangement, number, and shapes of flags to any methods.

The area between the positions A and C, determined as described above, is defined as a first area. If any one of the developing sleeves of the developing unit constituting the rotative color developing unit 116 is located within the first area relative to the photosensitive drum 111, the main body control unit 200 disables image information not only in the color selection (ACS) mode and color mode but also in the black and white mode.

On the other hand, when the rotative color developing unit 116 is located within a second area different from the first area, i.e. at a position where the optical sensor 1006 does not detect the developing position detecting positions 1108, 1109, and 1110, the rotative color developing unit does not affect image formation in the black and white mode.

Figure 10:
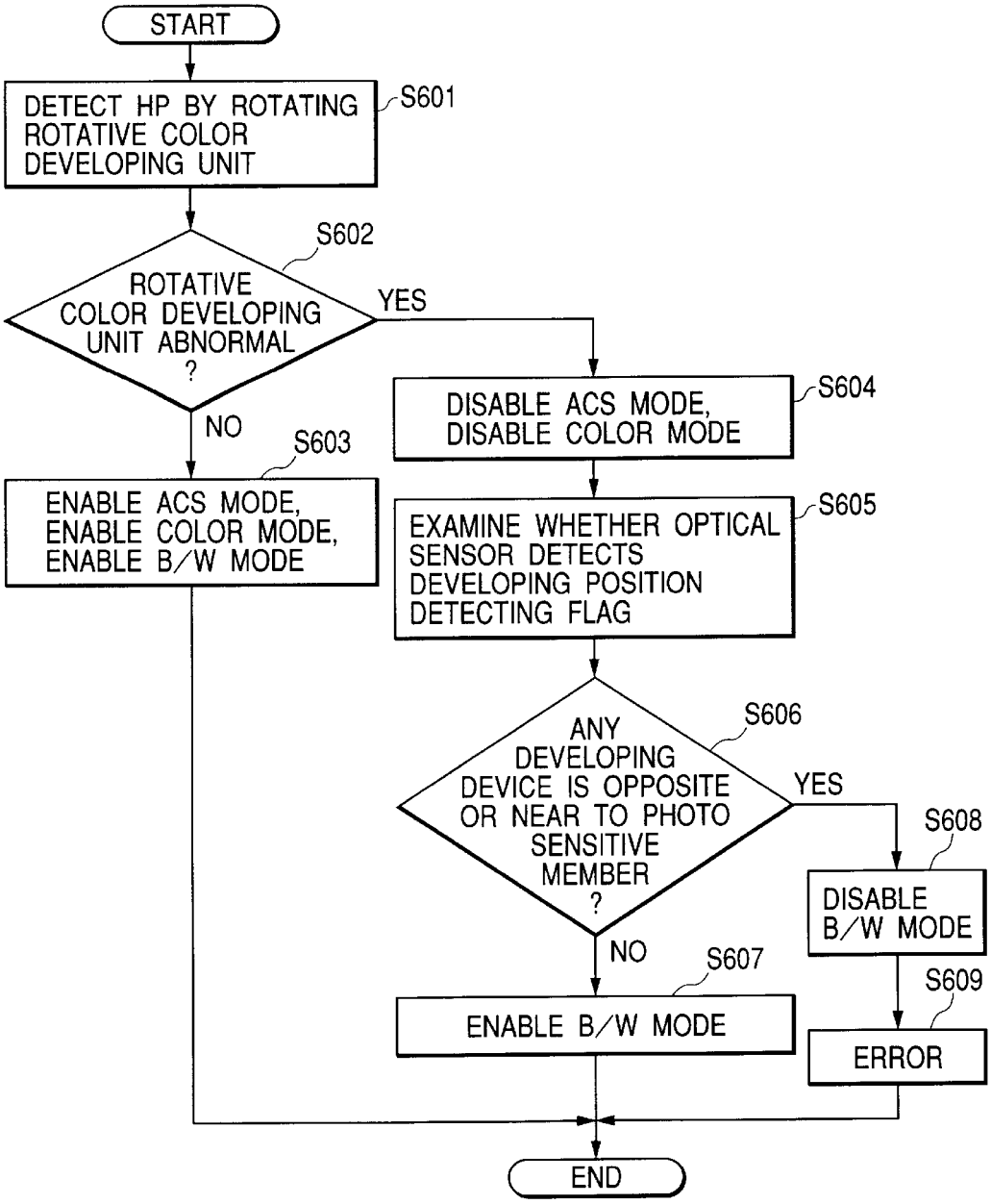
FIG. 10 is a flow chart of a process executed when it is detected that the rotative color developing unit is rotating incorrectly, upon power-on of the image forming apparatus main body 100 or recovery from a sleep mode.

FIG. 10 is a flow chart showing how it is detected that the rotative color developing unit 116 is rotating incorrectly while the developing unit 116 is performing a home position detecting operation. First, the main body control unit 200 attempts to detect the home position by rotating the rotative color developing unit 116 (S601). At this time, if the home position is detected before the CPU of the main body control unit 200 has transmitted pulses corresponding to one round of the stepping motor to the motor driver 1302, then it is determined that no error is occurring. If the home position flag cannot be detected in spite of pulses corresponding to one round of the motor, then the program stored in the ROM of the main body control unit 200 determines that the rotative color developing unit 116 operates incorrectly (S602). If it is determined that no error is occurring in the rotative color developing unit, image formation is enabled in all of the automatic color selection (ACS) mode, color mode, and black and white mode (S603). At this time, the standard screen on the LCD 304 is as shown in FIG. 5. On the other hand, if it is determined that an error is occurring in the rotative color developing unit 116, then the automatic color selection (ACS) mode and the color mode are first disabled (S604). Then, it is checked whether or not the optical sensor 1006 is detecting the developing position detecting flags (S605). It is thus determined whether or not any of the developing units of the rotative color developing unit is present at the position where it is opposite to the photosensitive drum or in the vicinity thereof (whether or not any of the developing units of the rotative color developing unit is present within the first area, including the position opposite to the photosensitive drum, i.e. whether or not any of the developing units is located so as to affect black development) (S606). If any of the developing units is located at the position where it is opposite to the photosensitive drum or in the vicinity thereof (any of the developing units is present within the first area, including the position opposite to the photosensitive drum, i.e. any of the developing units is located so as to affect black development), then image formation in the black and white mode is also disabled (S608). Then, the image forming apparatus 100 is brought into an error state (S609). Then, this state is indicated on the LCD 304, and the start key 302 on the operation unit is lighted red and cannot be depressed. On the other hand, if none of the developing units is located in contact with the photosensitive drum or in the vicinity thereof (none of the developing units is present within the first area, including the position opposite to the photosensitive drum, i.e. none of them are located so as to affect black development), then the color developing unit does not affect the image formation in the black and white mode. Thus, only the image formation in the black and white mode is enabled (S607). At this time, the screen on the LCD 304 is as shown in FIG. 6.

Now, description will be given of how the rotative color developing unit 116 is controlled when the developing color is switched, and then how an error is determined to be occurring. The developing color is switched in the color mode or automatic color selection (ACS) mode, and it is also done when patches are formed on the photosensitive drum 111 in order to correct density.

Figure 11:
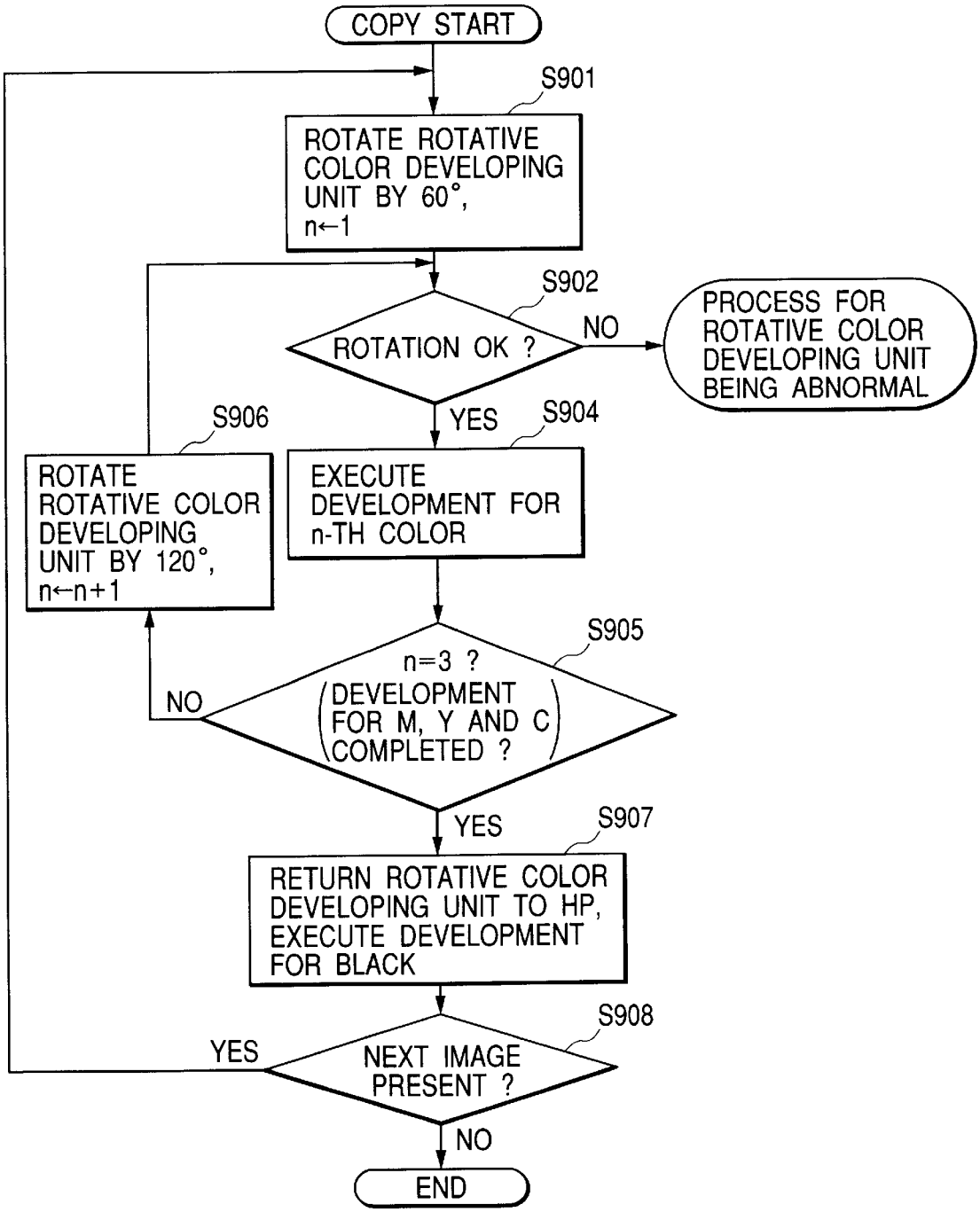
FIG. 11 is a flow chart showing how driving of the rotative color developing unit is controlled in a color image formation mode.

FIG. 11 shows how driving of the rotative color developing unit 116 is controlled in the color mode. The rotative color developing unit 116 rests at its home position when an image forming operation is started. At this time, the developing sleeve 1003 for magenta, the first color, is present at an angle of 60° to the position where it is located opposite the photosensitive drum 111. Thus, to form a color image, the rotative color developing unit 116 is first rotated by 60° (S901). Then, it is determined whether or not the rotative color developing unit 116 rotated correctly (S902). If it is determined that the rotative color developing unit 116 rotated correctly, a developing process is subsequently executed (S904). A process executed if an error is occurring (S903) will be described later in detail with reference to FIG. 12. Once the developing process for the first color has been completed, the rotative color developing unit 116 is rotated by 120° so that the developing sleeve for yellow 1004, the second color, is located opposite the photosensitive drum 111. The subsequent procedure till the start of a developing process is similar to the one executed for the first color (S902 to S904). Once the second color, yellow, has been developed, a similar process is executed on the third color, cyan. Once magenta, yellow, and cyan have been developed, the rotative color developing unit 116 returns to its home position on the basis of a home position detecting operation. Further, the black developing unit 115, provided separately from the rotative color developing unit 116, is used to develop black (S907). Thus, the developing process is completed. Then, it is determined whether or not further image formation is to be carried out (S908). If it is determined that further image formation is to be carried out, the process returns to the first step (S901). If it is no longer necessary to carry out image formation, the process is ended. In the B/W image formation mode, the rotative color developing unit 116 is not controlled but remains at its home position, with only the black developing unit 115 used for a developing process.

On the other hand, in the automatic color selection (ACS) mode, it is determined whether each image to be formed is colored or black and white. If the image is colored, the rotative color developing unit 116 is controlled using the same procedure as that used in the color mode, shown in FIG. 11. If the image is black and white, only the black developing unit 115 is used for development as in the case with the black and white mode.

The developing position detecting flags 1108, 1109, and 1110, shown in FIG. 8, are used to determine whether or not the rotative color developing unit 116 is rotating incorrectly while a color image is being formed in the color mode or the automatic color selection (ACS) mode. For example, it is assumed that the rotative color developing unit 116 is rotated by 60° from its home position in order to place the developing sleeve 1103 for magenta, the first color, opposite the photosensitive drum 111. Then, it is determined that the rotative color developing unit 116 is rotating incorrectly if the optical sensor 1106 cannot detect the developing position detecting flag 1108 even with pulses corresponding to a rotation of an angle of 60° being transmitted to the stepping motor. Likewise, when the developing sleeve 1104 or 1105 for the second or third color, yellow or cyan, respectively, is placed opposite the photosensitive drum 111, it is determined that the rotative color developing unit 116 is rotating incorrectly if the optical sensor 1106 cannot detect the developing position detecting flag 1109 or 1110, respectively, even with pulses corresponding to a rotation of an angle of 120° being transmitted to the stepping motor.

In connection with the time to switch the developing color, once it is determined the rotative color developing unit 116 is rotating incorrectly, it is also determined that none of the developing sleeves is present at the position where it is opposite to the photosensitive drum 111 or in the vicinity thereof.

Figure 12:
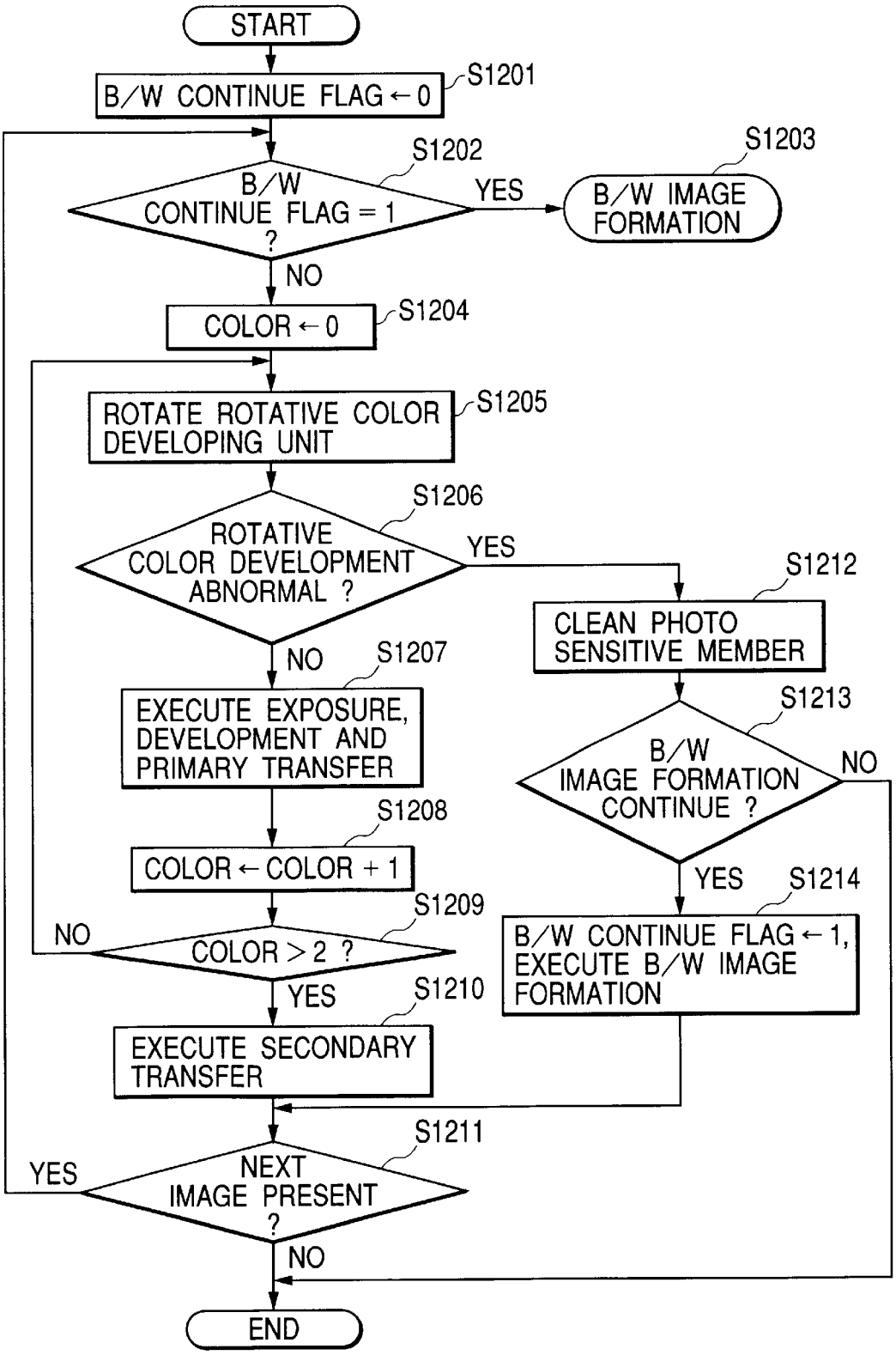
FIG. 12 is a flow chart of a process executed when it is detected that the rotative color developing unit is rotating incorrectly.

FIG. 12 is a flow chart showing a process executed if incorrect rotation of the rotative color developing unit is detected when a color image is formed in the automatic color selection (ACS) mode or the color mode. As soon as a color image starts to be formed, the main body control unit 200 initializes a B/W continue flag (S1201). At the next step, it is checked whether or not this flag has been set (S1202). Then, the number corresponding to the first developing unit to be used for development is set in a developing unit flag (S1204). Then, predetermined pulses are transmitted to the stepping motor 1301 by the CPU of the main body control unit 200 transmitting the pulses to the motor driver 1302, which controls the stepping motor 1301. Thus, the rotative color developing unit is rotated (S1205). At this time, it is checked whether or not the optical sensor 106 is detecting the developing position detecting flags to determine whether or not the rotative color developing unit is rotating incorrectly (S1206). If it is determined that no error is occurring, a series of processes are executed including exposure, development, and primary transfer (S1207). Then, similar operations are performed on all developing units (S1208, S1209, and S1205 to S1207). Once all developing units have completed development, secondary transfer is carried out (S1210). Furthermore, if there are the next image data to be processed (S1211), the procedure returns to step S1202 to execute a similar process.

In the flow of the series of processes described above, at step S1206, where it is determined whether or not the rotative color developing unit 116 is rotating incorrectly, if it is determined that an error is occurring, then the photosensitive drum is cleaned (S1212) because the rotative color developing unit 116 does not affect image formation in the black and white mode. Then, the main body control section 200 uses the LCD 304 to ask the user whether image formation is to be continued in the black and white mode (S1213). At this time, if the user desires to continue the process, the B/W continue flag is set to start forming, in the black and white mode, an image that has not been completed owing to detection of an error (S1214). Furthermore, the subsequent image formation is continuously carried out in the black and white mode (S1203). If at step S1213, the user does not desire to continue the process, the process is ended. After all processes have been completed, the display screen on the LCD 304 is as shown in FIG. 6. That is, the B/W image formation mode is enabled, whereas the other modes are disabled.

In this embodiment, provision of the home position detecting flag, the developing position detecting flags, and the optical sensor that detects these flags has been described as a mechanism for detecting the position of the rotative color developing unit 116 such as the home position or developing position and determining whether or not error is occurring.

Of course, other methods can be used to detect the position of the rotative color developing unit 116 and determine whether or not an error is occurring. The present invention is not limited to the above described embodiments.

Figure 13:
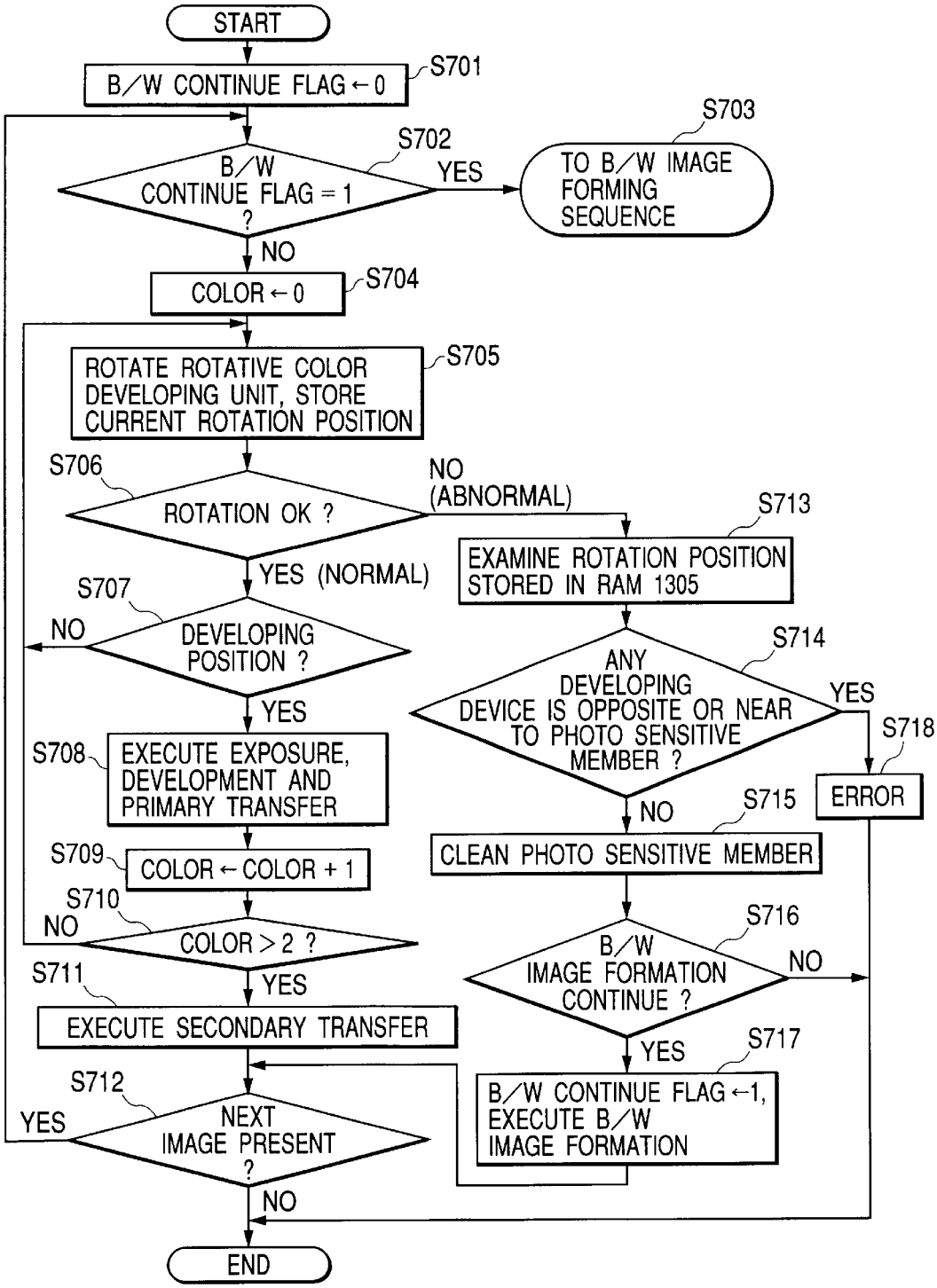
FIG. 13 is a flow chart of a process executed when it is detected that the rotative color developing unit is rotating incorrectly, when color images are formed.

For example, the position of the developing unit can be detected by providing a plurality of marks outside the rotative color developing unit 116 in line along a circumference thereof, further providing a mark indicative of the home position, and using the sensor to detect marks during rotation to count the number of them. The occurrence of an error can also be determined by measuring the time for which the marks are detected. Further, more precise position detection and error determination can be achieved by providing a rotary encoder in which the above principle is embodied, on the central axis of the rotative color developing unit 116. FIG. 13 is a flow chart showing a process executed if in such an embodiment, it is detected that the rotative color developing unit is rotating incorrectly when a color image is formed in the automatic color selection (ACS) mode or the color mode. When a color image starts to be formed, the B/W continue flag is initialized (S701). At the next step, it is checked whether or not this flag has been set (S702). Then, the number corresponding to the first developing unit to be used for development is set in the developing unit flat (S704). Then, the rotative color developing unit is rotated, and the current rotative position is stored in the RAM 1305 (S705). At this time, if it is determined that the rotative color developing unit is rotating correctly, then it is checked whether or not the current rotative position corresponds to the position where development is carried out (where the developing unit is in contact with the photosensitive drum) (S707). If the former corresponds to the latter, the developing unit is moved to the developing position (S705 to S707). Once the developing unit reaches the developing position, the series of processes are executed including exposure, development, and primary transfer (S708). Then, similar operations are performed on all developing units (S709, S710, and S705 to S708). Once all developing units have completed development, secondary transfer is carried out (S711). Furthermore, if there are the next image data to be processed, the procedure returns to step S702 to execute a similar process (S712). In the flow of the series of processes, at step S705, where the rotative color developing unit is rotated, if it is determined that the rotative color developing unit is rotating incorrectly, the rotative position of the rotative color developing unit stored in the RAM 1305 is checked (S713) to see whether or not any of the developing units of the rotative color developing unit is present at the position where it is in contact with the photosensitive drum or in the vicinity thereof (whether or not any of the developing units of the rotative color developing unit is present within the first area, including the position opposite to the photosensitive drum) (S714). If any developing unit is present at the position where it is in contact with the photosensitive drum or in the vicinity thereof (whether or not any of the developing units of the rotative color developing unit is present within the first area, including the position opposite to the photosensitive drum), then the image forming apparatus 100 is brought into an error state (S718). Then, this state is indicated on the LCD 304, and the start key 302 lighted red. If none of the developing units are present at the position where it is in contact with the photosensitive drum or in the vicinity thereof (none of the developing units in the rotative color developing unit are present within the first area, including the position opposite to the photosensitive drum), then the color developing unit does not affect the image formation in the black and white mode. Thus, the photosensitive drum is cleaned (S715). The LCD 304 is then used to ask the user whether image formation is to be continued in the black and white mode (S716). At this time, if the user desires to continue the process, the B/W continue flag is set to start forming, in the black and white mode, an image that has not been completed owing to detection of an error (S717). Furthermore, the subsequent image formation is continuously carried out in the black and white mode (S703). If the user cancels the process, the process is ended. After all processes following step S715 have been completed, the display screen on the LCD 304 is as shown in FIG. 6. That is, the B/W image formation mode is enabled, whereas the other modes are disabled.

The first developing unit has essentially been described as a rotative color developing unit. However, the configuration need not be such that a plurality of developing units are arranged around the axis of rotation. Further, in the above description, the first developing unit has three colors, magenta, yellow, and cyan. However, the first developing unit may have four colors including black, or a plurality of developing units may have the same color. For example, if the first developing unit has magenta, yellow, cyan, and black, while the second developing unit has black for characters, then B/W outputs are possible even if the first developing unit becomes defective. Furthermore, for character images, good outputs can be maintained. Further, the second developing unit has essentially been described as a B/W developing unit. However, the second developing unit may have another color. Alternatively, both first and second developing units may be of a rotative type. In this case, as in the case with this embodiment, in response to detection of a failure in the first developing unit, the operational state of the second developing unit is checked. If it is determined that the second developing unit operates correctly, image formation can be continued by using only the second developing unit.

What is claimed is:

1. An image forming apparatus including a latent image carrier, a first developing unit having a plurality of developing units and provided so as to face the latent image carrier at a predetermined developing position, and a second developing unit provided so as to face the latent image carrier at a developing position different from that for the first developing unit, said first developing unit having a plurality of developing units arranged around an axis of rotation, said first developing unit carrying out development by rotating any of said developing units around the axis of rotation to a developing position at which the developing unit is located opposite the latent image carrier, said apparatus comprising:

an operation determining unit that determines a rotation status of the first developing unit; and a control unit having a first mode in which said first developing unit is used to form an image and a second mode in which an image is formed without using said first developing unit, the control unit being able to provide such control that the first mode is avoided on the basis of a result of the determination by the operation determining unit.

2. The image forming apparatus according to claim 1, wherein said operation determining unit further comprises an error determining unit which determines whether or not said first developing unit is rotating incorrectly and a position determining unit which determines a rotative position of said first developing unit.

3. The image forming apparatus according to claim 2, wherein if said error determining unit determines that said first developing unit is rotating incorrectly, then in response to said position determining unit determining that none of said plurality of developing units are present within a predetermined area including the position at which the developing unit faces said latent image carrier, said control unit provides such control that said first mode is avoided and that an image is formed in said second mode.

4. The image forming apparatus according to claim 2, wherein if said error determining unit determines that said first developing unit is incorrectly rotating, said control unit provides such control that said first mode and said second mode are avoided in response to said rotative position determining unit determining that any one of said plurality of developing units is present within the predetermined area including the position at which the developing unit faces said latent image carrier.

5. The image forming apparatus according to claim 1, wherein said first developing unit has a plurality of color developing units, and said first mode is a color image formation mode.

6. The image forming apparatus according to claim 1, wherein said second mode is a single-color image formation mode.

7. The image forming apparatus according to claim 2, wherein said control unit has an automatic selection mode in which said first mode and said second mode are switched depending on a read original document, and provides such control that said automatic selection mode is avoided when said error determining unit determines that an error is occurring.

8. The image forming apparatus according to claim 2, wherein said control unit provides such control that in response to said error determining unit determining in the first mode that said first developing unit is rotating incorrectly, said position determining unit determines whether or not any of said plurality of developing units is present within the first area including the position at which the developing unit faces said latent image carrier.

9. The image forming apparatus according to claim 2, wherein said control unit provides such control that if in the first mode, said error determining unit determines that said first developing unit is rotating incorrectly, then in response to said position determining unit determining that none of said plurality of developing units is present within the first area including the position at which the developing unit faces said latent image carrier, the first mode is paused and image formation can be continued in the second mode.

10. The image forming apparatus according to claim 9, further comprising a display unit, wherein if said control unit pauses the first mode and enables image formation to be continued in the second mode, said display unit asks a user whether image formation is to be continued in the second mode.

11. The image forming apparatus according to claim 3, wherein said predetermined area includes an area in which any one of said plurality of developing units faces, said latent image carrier or in the vicinity thereof to affect image formation.

12. The image forming apparatus according to claim 4, wherein said predetermined area includes an area in which any one of said plurality of developing units faces, said latent image carrier or in the vicinity thereof to affect image formation.

13. The image forming apparatus according to claim 1, wherein said plurality of developing units each have developing sleeves.

14. An image forming apparatus including a latent image carrier, a first developing unit having a plurality of developing units and provided so as to face the latent image carrier at a predetermined developing position, and a second developing unit provided so as to face the latent image carrier at a developing position different from that for the first developing unit, said first developing unit having a plurality of developing units arranged around an axis of rotation, said first developing unit carrying out development by rotating any of said developing units around the axis of rotation to a developing position at which the developing unit is located opposite the latent image carrier, said apparatus comprising:

an operation determining unit that determines whether or not development using said plurality of developing units by rotation of said first developing unit is possible; and a control unit having a first mode in which said first developing unit is used to form an image and a second mode in which an image is formed without using said first developing unit, the control unit being able to provide such control that the first mode is avoided on the basis of a result of the determination by the operation determining unit.

15. The image forming apparatus according to claim 14, wherein if said operation determining unit determines that the development using said plurality of developing units by rotation of said first developing unit is impossible, said control unit provides such control that said first mode is avoided and that an image is formed in said second mode.

16. The image forming apparatus according to claim 14, wherein said control unit has an automatic selection mode in which said first mode and said second mode are switched depending on a read original document, and provides such control that said automatic selection mode is avoided in response to said operation determination unit determining that the development using said plurality of developing units by rotation of said first developing unit is impossible.

17. The image forming apparatus according to claim 14, wherein in response to said operation determining unit determining that the development using said plurality of developing units by rotation of said first developing unit is impossible, it is further determined whether or not any of said plurality of developing units is present within a first area including a position at which the developing unit faces said latent image carrier.

18. The image forming apparatus according to claim 14, wherein said control unit provides such control that in the first mode, in response to said operation determining unit determining that the development using said plurality of developing units by rotation of said first development is impossible and that one of said plurality of developing units is not present within a first area including a position at which the developing unit faces said latent image carrier, the first mode is paused and image formation can be continued in the second mode.

19. The image forming apparatus according to claim 14, wherein when said operation determining unit determines that the development using said plurality of developing units by rotation of said first developing unit is impossible, said control unit provides such control that said first mode and said second mode are avoided in response to said operation determining unit determining that any one of said plurality of developing units is present within a first area including a position at which the developing unit faces said latent image carrier.

* * * * *

UNITED STATES PATENT AND TRADEMARK OFFICE

CERTIFICATE OF CORRECTION

PATENT NO. : 6,763,202 B2
DATED : July 13, 2004
INVENTOR(S) : Yuichiro Maeda

It is certified that error appears in the above-identified patent and that said Letters Patent is hereby corrected as shown below:

Column 1,
Line 17, “fails” should read -- fails to --.

Column 2,
Line 9, “convenient of” should read -- convenience to --.

Column 5,
Line 53, “comprises” should read -- comprised --.

Column 6,
Line 47, “above described” should read -- above-described --.

Column 7,
Line 3, “107.,” should read -- 107, --.

Column 10,
Line 9, “3 or mm” should read -- 3mm or --.
Lines 14 and 16, “e.g.” should read -- e.g., --.

Column 13,
Line 66, “above described” should read -- above-described --.

Signed and Sealed this

Sixteenth Day of November, 2004

JON W. DUDAS
*Director of the United States Patent and Trademark Office*